US009062481B2

(12) United States Patent
Liao

(10) Patent No.: US 9,062,481 B2
(45) Date of Patent: Jun. 23, 2015

(54) ELECTROMAGNETIC DOORLOCK WITH SHOCK DETECTION AND POWER SAVING DEVICE

(71) Applicant: Li-Shih Liao, Taoyuan County (TW)

(72) Inventor: Li-Shih Liao, Taoyuan County (TW)

( * ) Notice: Subject to any disclaimer, the term of this patent is extended or adjusted under 35 U.S.C. 154(b) by 286 days.

(21) Appl. No.: 13/708,007

(22) Filed: Dec. 7, 2012

(65) Prior Publication Data

US 2013/0168976 A1 Jul. 4, 2013

(30) Foreign Application Priority Data

Dec. 30, 2011 (TW) ..... 100149727 A

(51) Int. Cl.

| | |
|---|---|
| ***E05C 17/56*** | (2006.01) |
| ***E05C 19/16*** | (2006.01) |
| *E05B 65/10* | (2006.01) |
| *E05B 47/00* | (2006.01) |

(52) U.S. Cl.

CPC ..... *E05C 19/166* (2013.01); *E05B 2047/0065* (2013.01); *E05B 2047/0068* (2013.01); *E05B 2047/0093* (2013.01)

(58) Field of Classification Search

USPC ..... 292/92–94, 251.5, DIG. 65

See application file for complete search history.

(56) References Cited

U.S. PATENT DOCUMENTS

| | | | | |
|---|---|---|---|---|
| 4,652,028 | A * | 3/1987 | Logan et al. | 292/251.5 |
| 4,703,962 | A * | 11/1987 | Kelly et al. | 292/251.5 |
| 4,720,128 | A * | 1/1988 | Logan et al. | 292/251.5 |
| 5,641,187 | A * | 6/1997 | Frolov | 292/251.5 |
| 6,053,546 | A * | 4/2000 | Frolov | 292/251.5 |
| 6,135,515 | A * | 10/2000 | Roth et al. | 292/251.5 |
| 6,260,892 | B1 * | 7/2001 | Chang | 292/251.5 |
| 6,609,738 | B1 * | 8/2003 | Roth et al. | 292/251.5 |
| 2007/0262592 | A1 * | 11/2007 | Hwang et al. | 292/251.5 |
| 2011/0018680 | A1 * | 1/2011 | Lai et al. | 340/3.1 |

* cited by examiner

*Primary Examiner* — Kristina Fulton
*Assistant Examiner* — Faria Ahmad
(74) *Attorney, Agent, or Firm* — Rosenberg, Klein & Lee

(57) ABSTRACT

The invention relates to an electromagnetic doorlock with shock detection and power saving device comprises an electromagnet assembly and a corresponding adsorption assembly. The electromagnet assembly is connected to a shock detection module and the adsorption assembly has a suppressing unit to abut the shock detection module. When the door is opened, the electromagnet assembly does not supply power; when the door is closed, the electromagnet assembly with electromagnetic attraction adsorbs the adsorption assembly and the suppressing unit suppresses the shock detection module. That is, the electromagnetic doorlock usually stays in a low-energy adsorption state; however, when a shock detection module is triggered, the electromagnetic doorlock returns to normal lock state for achieving power saving effect and control of the external force detection improvement.

11 Claims, 13 Drawing Sheets

ELECTROMAGNETIC DOORLOCK WITH SHOCK DETECTION AND POWER SAVING DEVICE

BACKGROUND OF THE INVENTION

1. Field of the Invention

The invention relates to an electromagnetic doorlock, particularly to the electromagnetic doorlock with shock detection and power saving device.

2. Description of the Related Art

In the access control monitoring system, the use of an electromagnetic door lock has been very popular. The electromagnetic door lock 10 as shown in FIG. 1 provides an electric magnet 11 mounted on a door frame 13 and an adsorption plate 12 mounted on a corresponding position of a door plate 14. When the electric magnet 11 is energized to produce electromagnetic attraction and adsorb the adsorption plate 12, the electromagnetic door lock 10 forms in a lock state. When the electric magnet 11 is de-energized and the adsorption plate 12 detaches from the electric magnet 11, the electromagnetic door lock 10 then forms in an unlock state. The above features are disclosed in U.S. Pat. No. 4,352,028.

Normally, the power consumption of the electromagnetic door lock 10 of the DC power is about tens of watts. If 12 volts of DC power is supplied, the consumption current maintains hundreds of mill-amperes (mA); thus, the electromagnetic door lock 10 requires a lot of electrical energy.

It is considerable that the safety monitoring system of the electromagnetic door lock requires practical applicability and controllability; therefore, energy saving design requires further improvement.

SUMMARY OF THE INVENTION

It is a primary object of the present invention to provide an electromagnetic doorlock with shock detection and power saving device, which usually stays in a low-energy adsorption state; however, when a shock detection module is triggered, the electromagnetic doorlock returns to normal lock state for achieving power saving and access control security effects.

It is a second object of the present invention to provide an electromagnetic doorlock with shock detection and power saving device having an adsorption plate with buffering displacement design for an electric magnet to have sufficient time to resume operation to ensure the security of access control.

In order to achieve the above objects, the present invention includes an electromagnetic doorlock with shock detection and power saving device according to claim 1.

Based on the features disclosed, the electromagnet assembly is arranged on a door frame and the adsorption assembly is correspondingly arranged on the door plate and the electromagnet assembly has a containing room with a cover at an opening thereof and the cover has a mounted hole thereon for mounting the shock detection module.

Further, the shock detection module further includes: the plate having a post hole with an upward opening at a center thereof and a hollow portion at an inner side thereof; a shaft having a flange at a middle section and a small spring arranged on a lower section thereof and arranged in the post hole; a positioning sleeve having a hook body at a side thereof for fixing on a fixed hole arranged at a periphery of the post hole and corresponding to the post hole has a through hole for arranging an upper section of the shaft; a recessed flexible body across set on the elastic member and having a recessed center corresponding to a top of the shaft; and an electrical trigger arranged on the recessed flexible body and corresponding to a trigger area at a bottom surface of the shock sensor. In the preferred embodiment, the shock sensor is composed of a G-sensor.

Furthermore, the suppressing unit includes: a base having a recessed surface with a screw hole in a center thereof and an abutment button having a front face corresponding to the abutment body of the shock detection module and a bottom face with a screw for screwing to the screw hole to adjust a height between the abutment button and a surface of the base.

DETAILED DESCRIPTION OF THE PREFERRED EMBODIMENT

Figure 6:
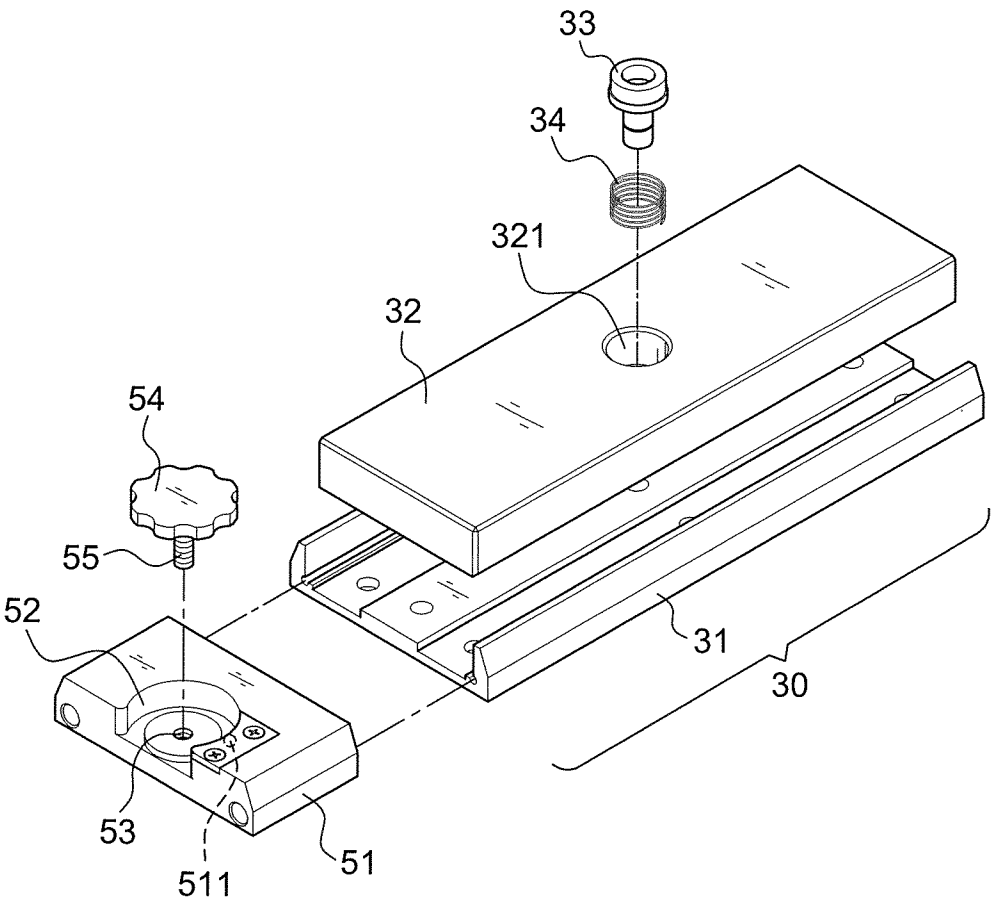
FIG. 6 is a perspective view of the present invention, illustrating the disassembly of the adsorption assembly and suppressing unit.
Figure 7:
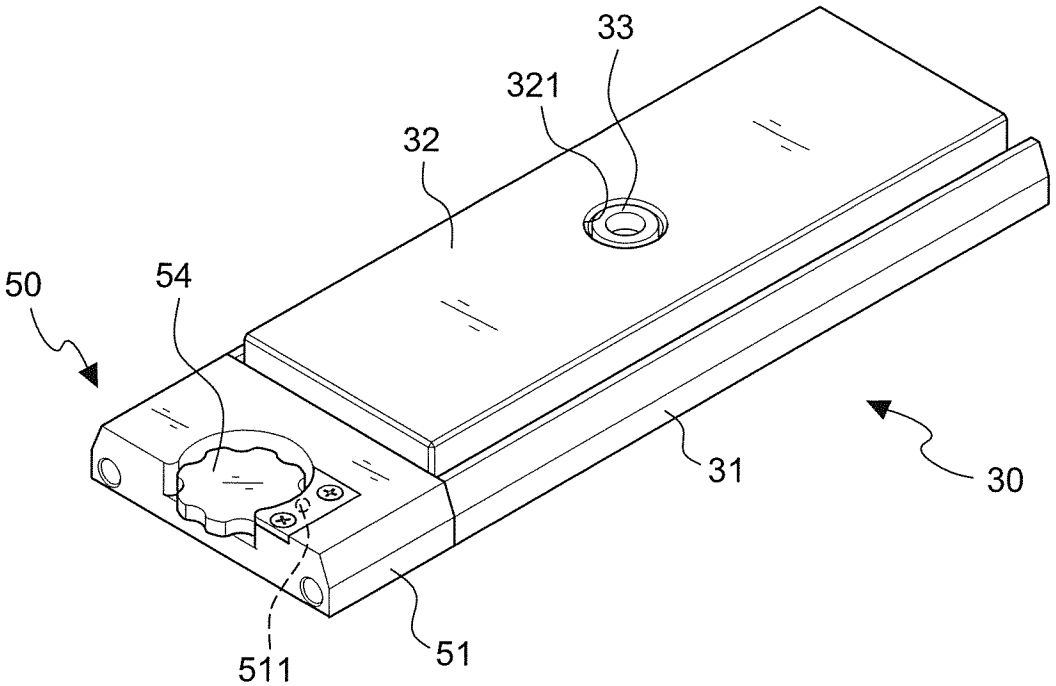
FIG. 7 is a perspective view of the present invention, illustrating the assembly of the adsorption assembly and suppressing unit.
Figure 8:
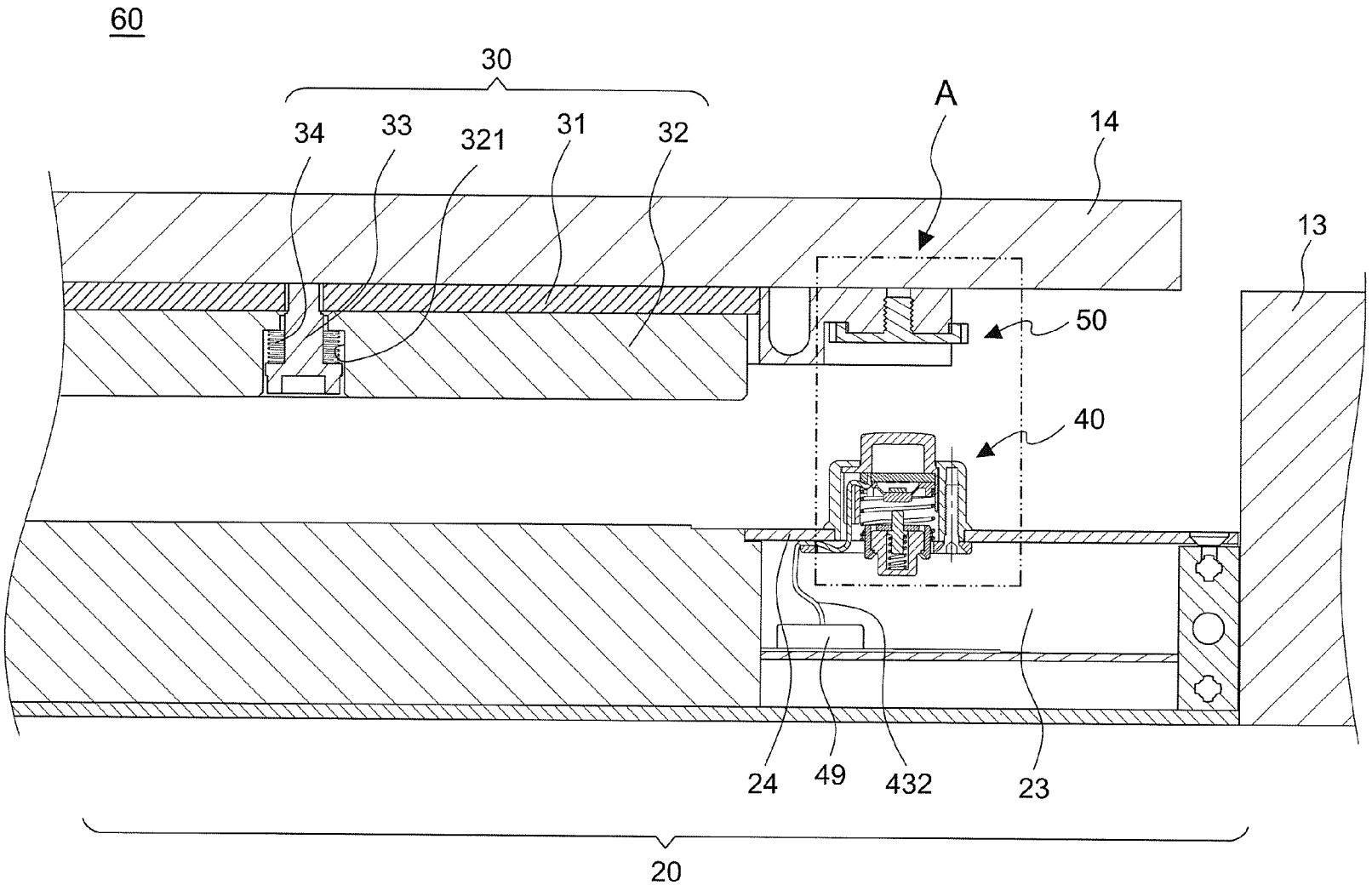
FIG. 8 is a sectional view of the present invention, illustrating the separation of the electromagnet assembly and adsorption assembly.
Figure 9:
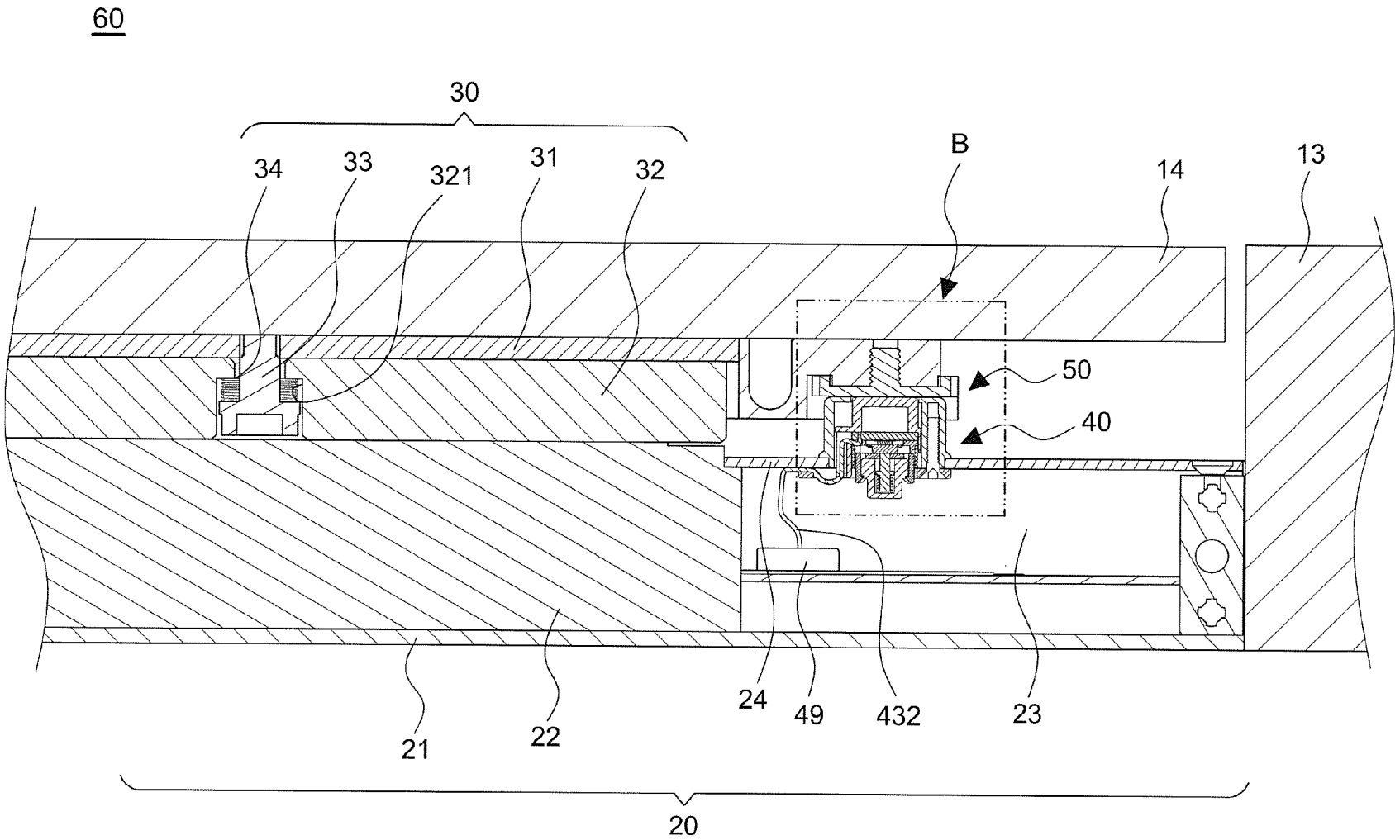
FIG. 9 is a sectional view of the present invention, illustrating the abutment of the electromagnet assembly and adsorption assembly.

With reference to FIGS. 2 through 12, the present invention discloses an electromagnetic doorlock 60 comprising an electromagnet assembly 20 and an adsorption assembly 30. In the embodiment as shown in FIGS. 8 and 9, the electromagnet assembly 20 is mounted on a door frame 13 and the adsorption assembly 30 is correspondingly mounted on a door plate 14. The electromagnet assembly 20 may be mounted on a door plate 14 and the adsorption assembly 30 may be correspondingly mounted on a door frame 13. However, the internal structure and external power connection method of the electromagnet assembly and adsorption assembly are prior art and thus will not be described in details here.

Figure 1:
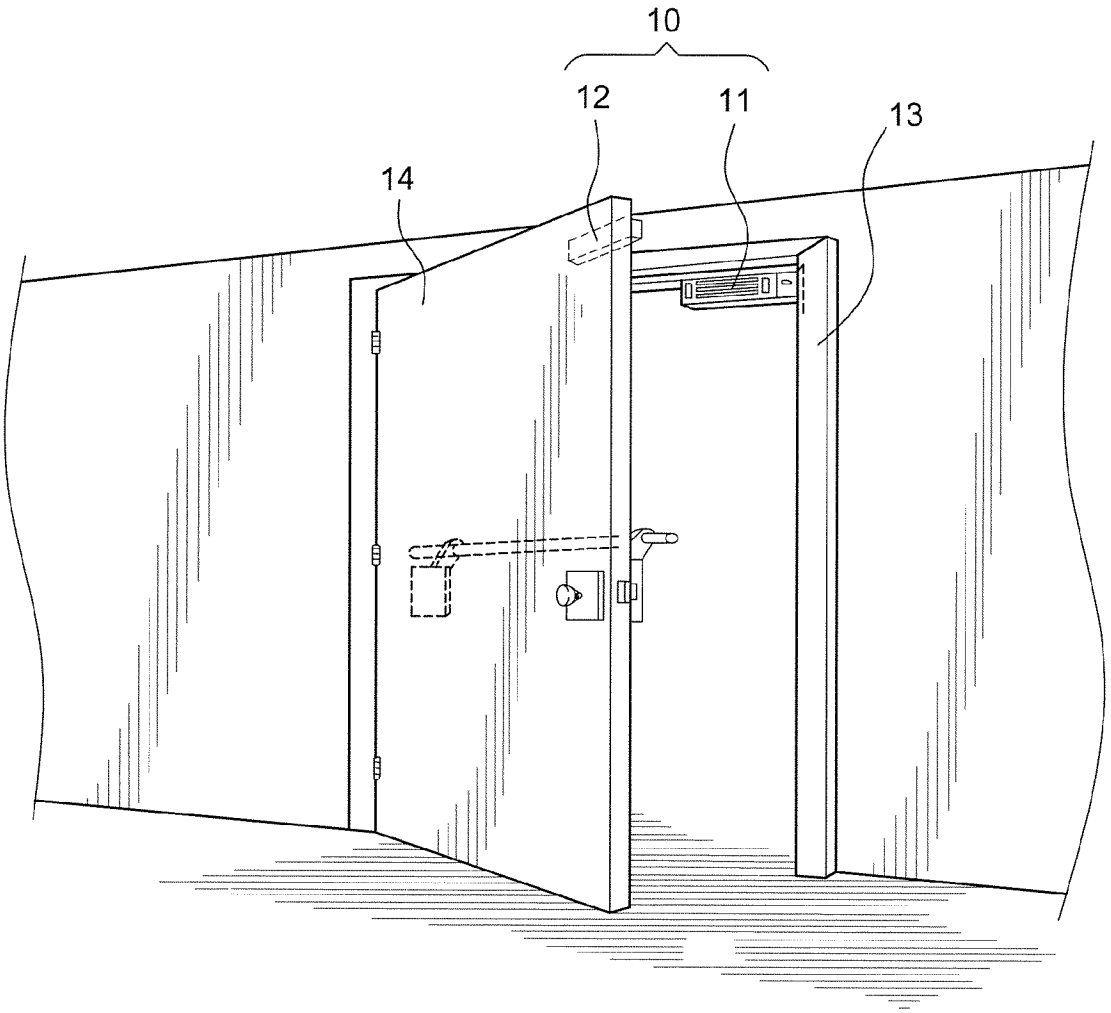
FIG.1 PRIOR ART
FIG. 1 is a schematic view of a conventional electromagnetic door lock.
Figure 2:
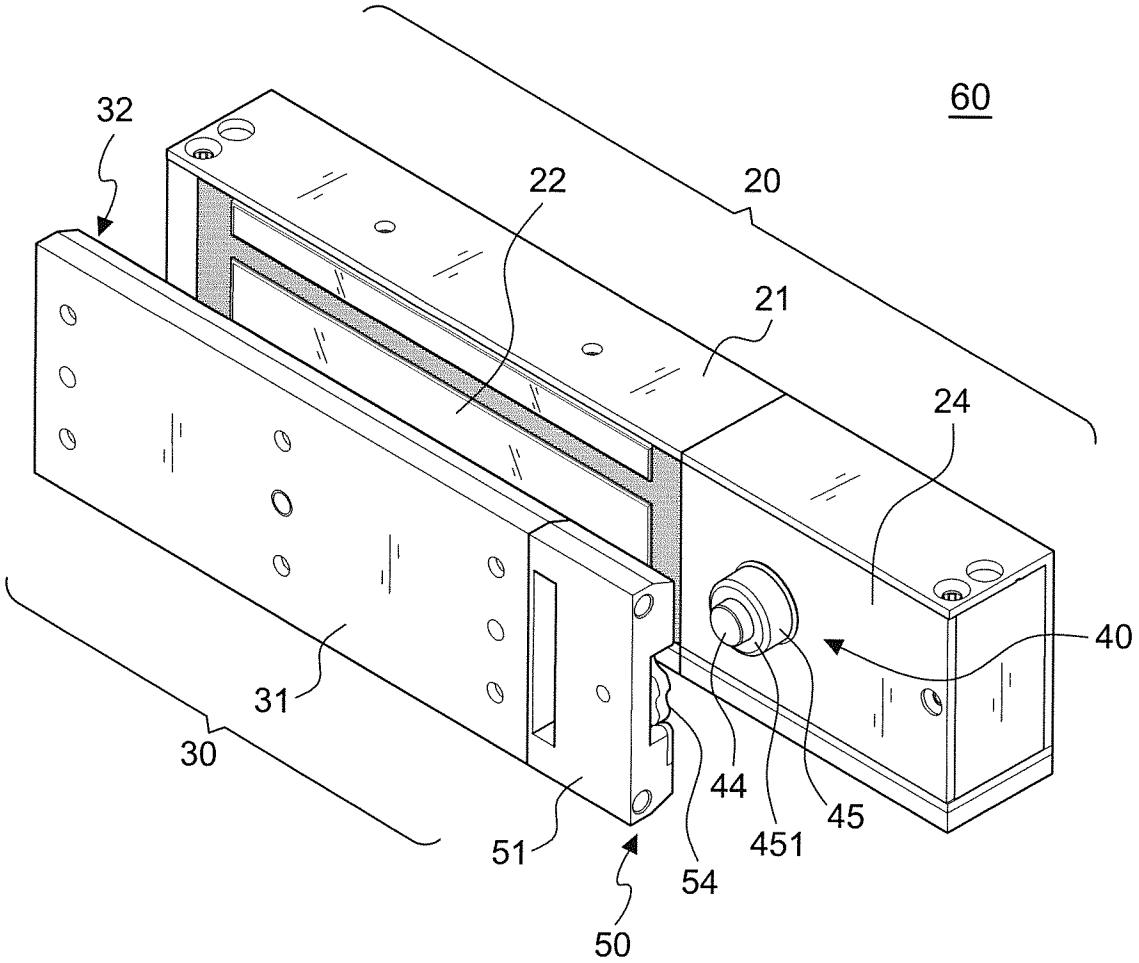
FIG. 2 is a perspective view of the separation of the present invention.
Figure 3:
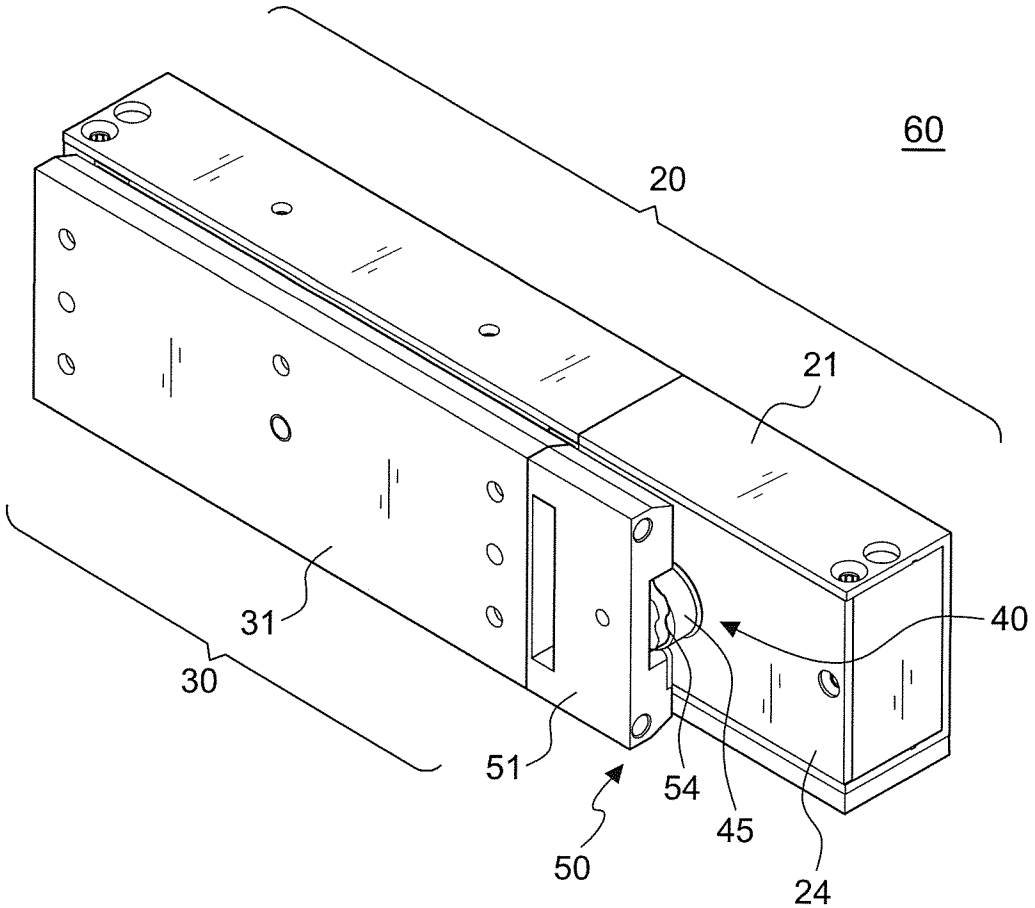
FIG. 3 is a perspective view of the adsorption and abutment of the present invention.
Figure 4:
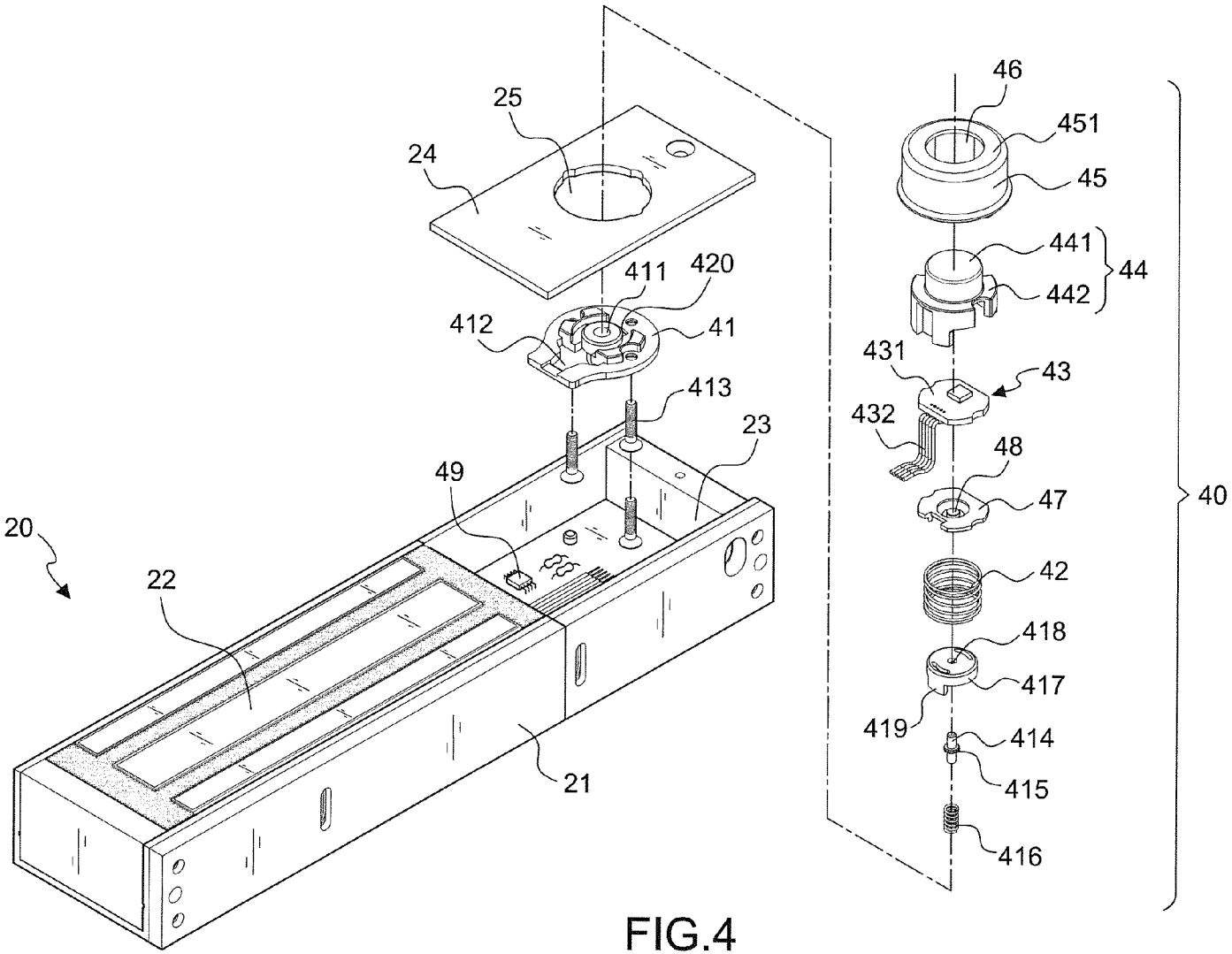
FIG. 4 is a perspective view of the present invention, illustrating the disassembly of the electromagnet assembly.
Figure 5:
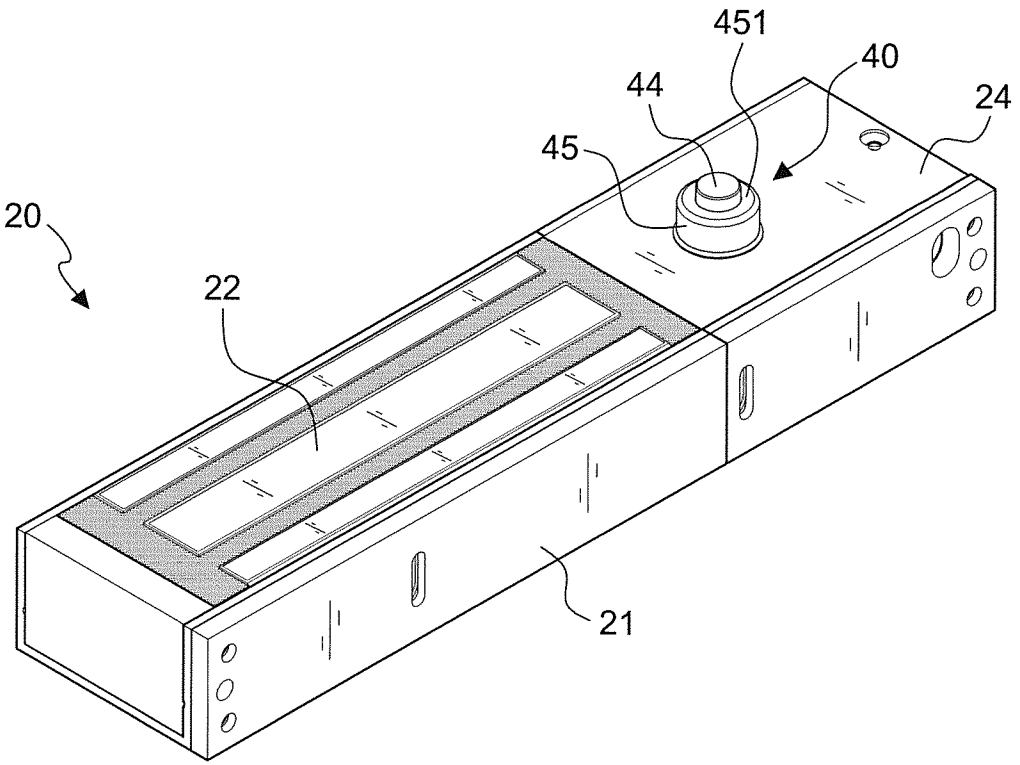
FIG. 5 is a perspective view of the present invention, illustrating the assembly of the electromagnet assembly.

The main features of the present invention comprise the electromagnet assembly 20 electronically connected to a shock detection module 40 and the adsorption assembly 30 having a suppressing unit 50 at a side thereof. The electromagnet assembly 20 includes a case 21 and an electric magnet 22 arranged in the case 21. The electric magnet 22 includes a core and a coil around the core to provide an electromagnetic attraction and the case 21 may include a resin coated around the electric magnet 22 or an outer housing; however, it is a prior art and thus will not be described in details here. In the preferred embodiment as shown in FIG. 4, the case 21 includes a containing room 23 arranged at a side of the electric magnet 22; the containing room 23 includes a cover 24 at an opening thereof; the cover 24 includes a mounted hole 25 thereon. Moreover, the containing room 23 may be an independent molding structure mounted on the electromagnet assembly 20 or may be integrally molded with the electromagnet assembly 20. In the embodiment as shown in FIG. 6, the adsorption assembly 30 has a mounted base 31 in a U-shape for placing an adsorption plate 32. The mounted base 31 may be directly molded on the door plate 14. The structure of the adsorption assembly 30 will be described hereafter.

With the reference to FIG. 4, the shock detection module 40 is mounted on the mounted hole 25. The shock detection module 40 may be mounted at a predetermined position of a periphery of the electromagnet assembly 20. In the embodiment, the shock detection module 40 includes: a plate 41, a shaft 414, a positioning sleeve 417, an elastic member 42, a recessed flexible body 47, a shock sensor 43, an electrical trigger 48, an abutment body 44 and a seat 45. The plate 41 is upward mounted at a bottom of the mounted hole 25 and fixed by a screw 413 and the base 41 may be integrally molded with the cover 24. The shaft 414 arranged in a post hole 411 includes a flange 415 at a middle section and a small spring 416 arranged on a lower section thereof. The positioning sleeve 417 includes a hook body 419 at a side thereof for fixing on a fixed hole 420 arranged at a periphery of the post hole 411 and the positioning sleeve 417 corresponding to the post hole 411 has a through hole 418 in a middle thereof for arranging an upper section of the shaft 414. The elastic member 42 is mounted on the positioning sleeve 417 and the elastic member 42 may be a spring. The recessed flexible body is 47 across set on the elastic member 42 and has a recessed center contacting with the shaft 414 and is push and moved upward by the shaft 414. The electrical trigger 48 is mounted on the recessed flexible body 47 and the shock sensor 43 may be set as a kind of circuit board module and has a trigger zone 433 on the recessed flexible body 47 and the trigger zone 433 has a bottom corresponding to the electrical trigger 48 and is connected to a wire 432. The wire 432 has a reserved length in a hollow portion 412 of the base 41 and an end arranged in the containing room 23 and electrically connected to a control circuit 49. The abutment body 44 mounted on the shock sensor 43 has a protrusion portion 441 and a positioning flange 442 at a periphery thereof. The seat 45 mounted on the mounted hole 25 includes an axial through hole 46 for the abutment body 44 to be axially telescoped therein and the telescopic abutment body 44 drives the shock sensor 43 to provide an upward elastic force for the abutment body 44 by the elastic member 42.

Figure 10:
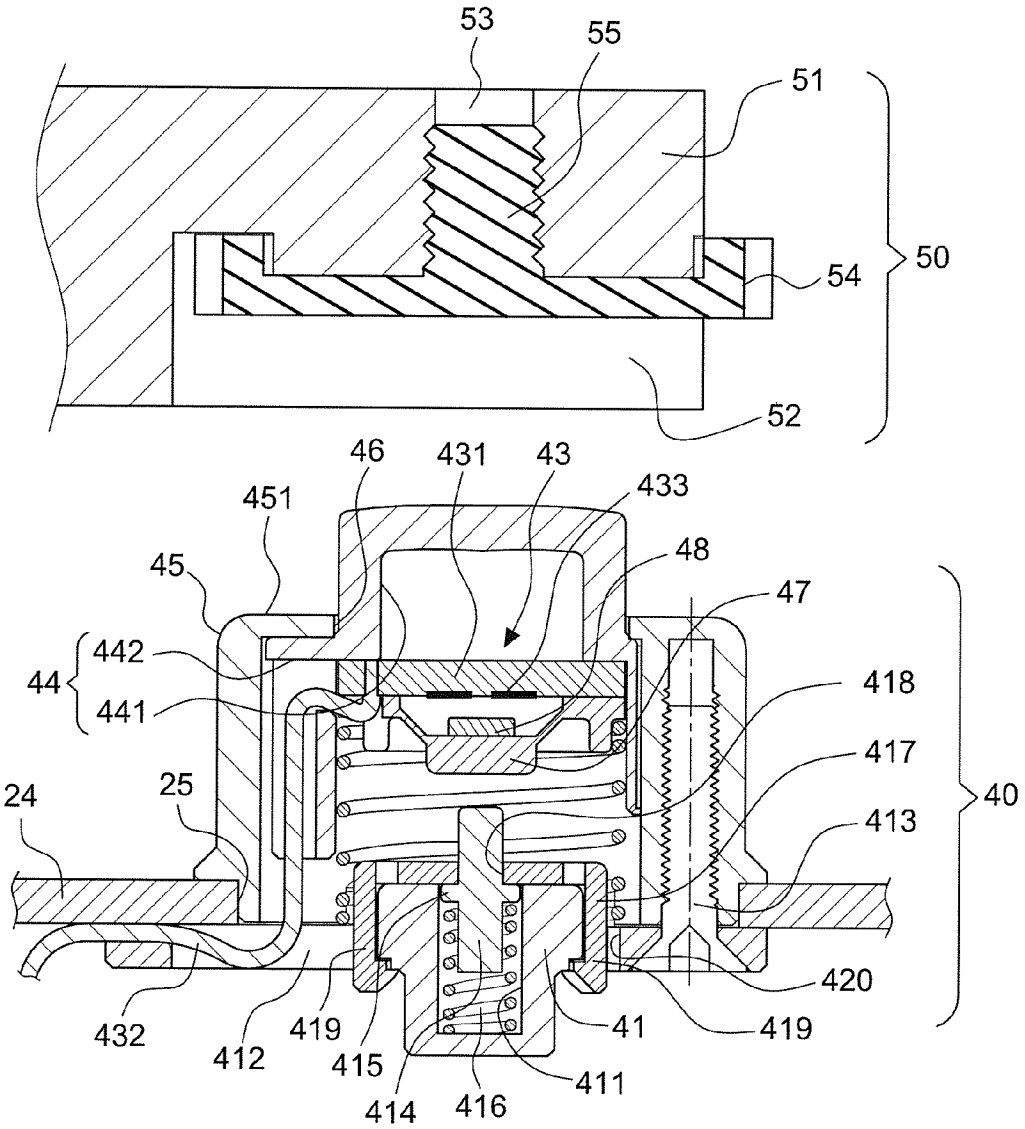
FIG. 10 is an enlarged view of part A of the FIG. 8.

With the referenced to FIG. 10, the seat 45 has a bottom inserted in the mounted hole 25 and a positioning surface 451 at a periphery of the axial through hole 46 for the positioning flange 442 to be abutted when the protrusion portion 441 of the abutment body 44 is upward pushed by the elastic body 42.

With the referenced to FIGS. 6 and 7, the adsorption assembly 30 mounted at a front side of the electromagnet assembly 20 comprises a mounted base 31, a adsorption plate 32 corresponding to the electric magnet 22 arranged an inner side of the mounted base 31 and has a spot-faced hole 321. The adsorption plate 32 is locked on the mounted base 31 from an inner side thereof by the spot-faced hole 321 and a bolt 33 and a spring 34 is mounted on the bolt 33 for having an elastic displacement space between the inner side of the adsorption plate 32 and the mounted base 31. In another embodiment, the adsorption plate 32 may be mounted on a door plate 14.

Figure 11:
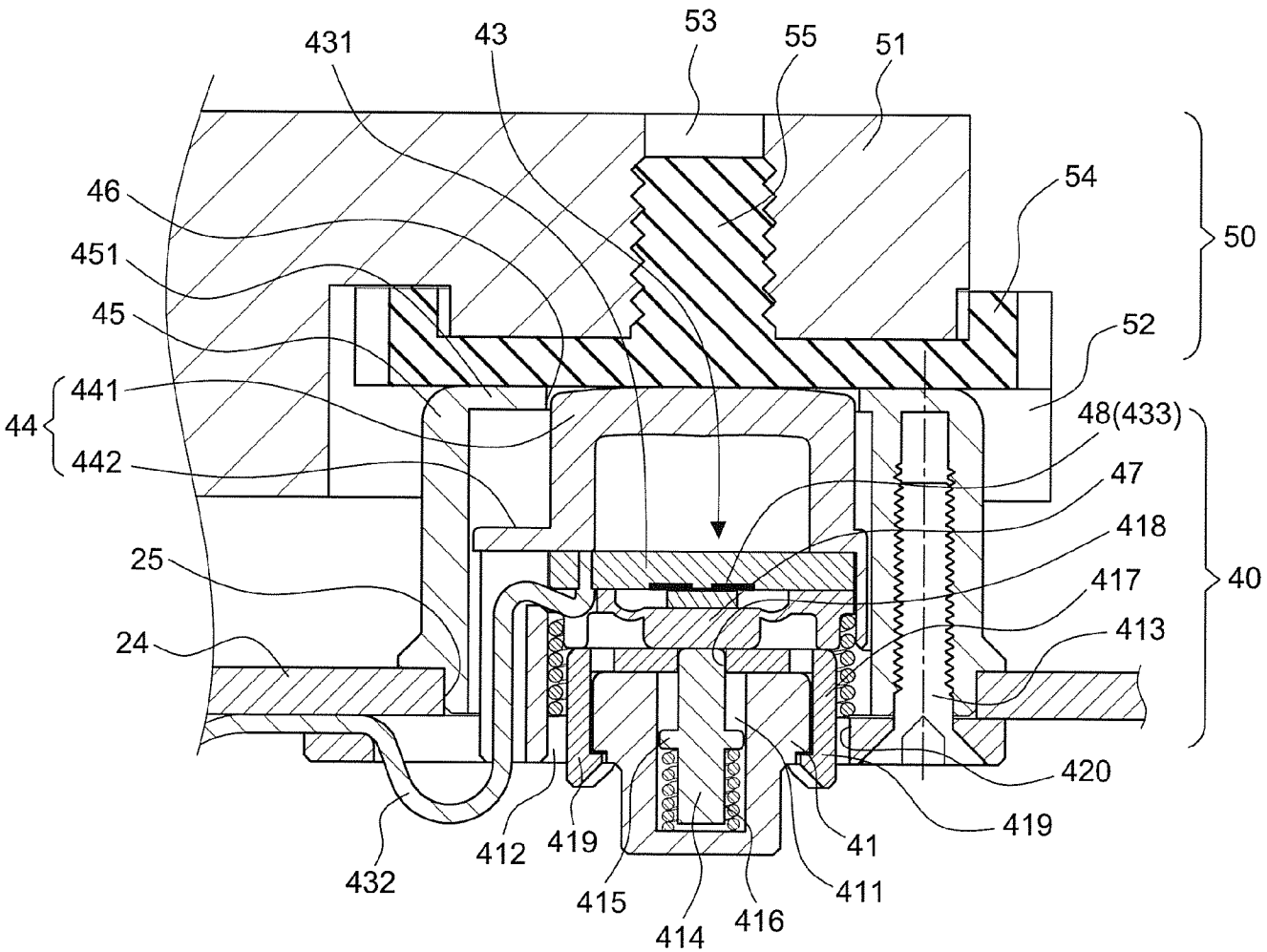
FIG. 11 is an enlarged view of part B of the FIG. 9.

A suppressing unit 50 is mounted on a periphery of the adsorption assembly 30. In the embodiment, the suppressing unit 50 is fixed at a side of the adsorption assembly 30 and includes a base 51 having a recessed surface 52 with a screw hole 53 in a center thereof and an abutment button 54 having a front face corresponding to the abutment body 44 of the shock detection module 40 and a bottom face with a screw 55 for screwing to the screw hole 53 to adjust a height between the abutment button 54 and a surface of the base 51 and pressed degree between the abutment button 54 and the abutment body 44 as shown in FIG. 11. Moreover, a resilient positioning member 511 as shown in FIG. 7 is mounted at a side of the abutment button 54 of the base 51. The resilient positioning member 511 may be an elastic piece or a flexible steel ball.

Figure 12:
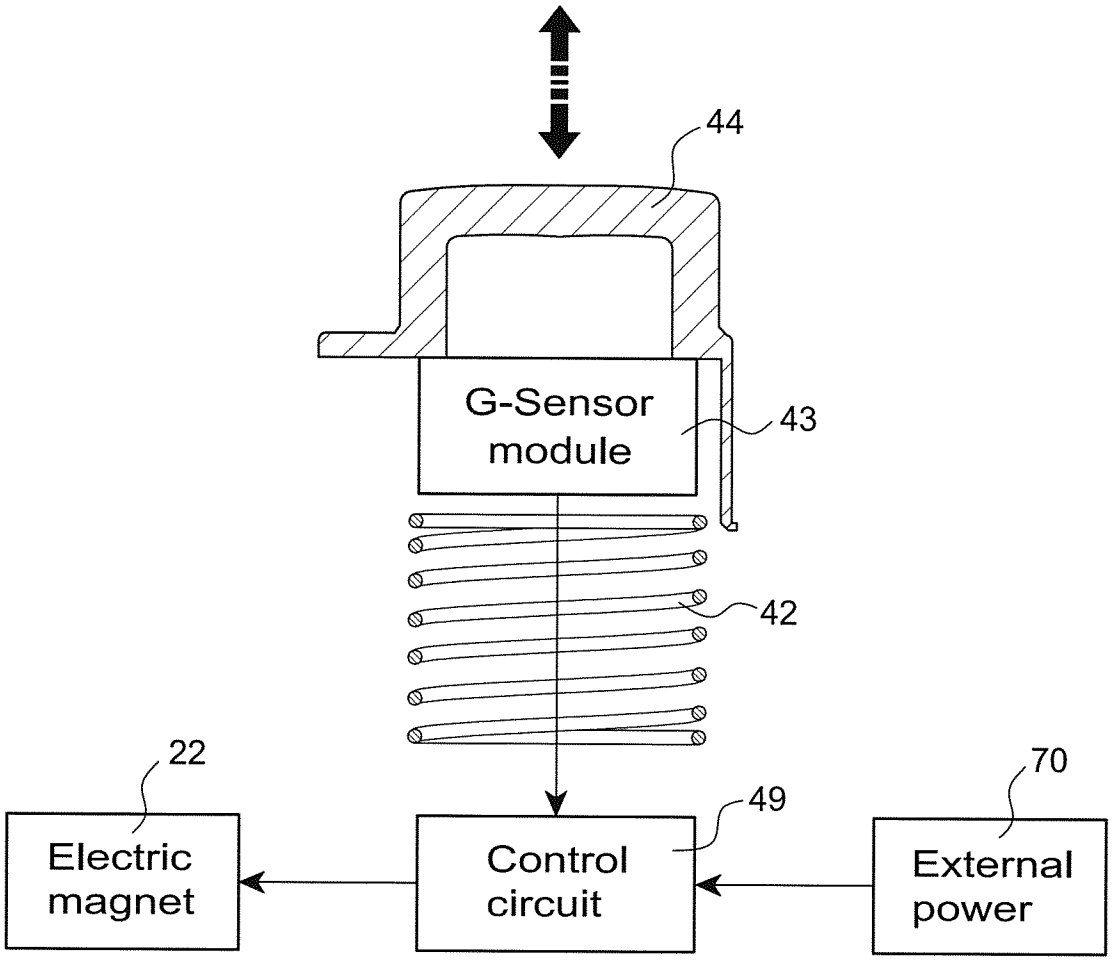
FIG. 12 is a control block view of the present invention.

With referenced to FIGS. 9, 11 and 12, the control circuit 49 is arranged in the containing room 23 of the electromagnet assembly 20 and an end thereof is connected to an external power 70 and another end is electronically connected to the electric magnet 22 for the power supply to be controlled and sent to the electric magnet 22.

Based on the features disclosed, when the door plate 14 is opened, the abutment button 54 of the suppressing unit 50 does not contact with the abutment body 44 on the door frame 13 and the control circuit 49 does not supply the normal power to the electric magnet 22. When the door plate 14 and the door frame 13 are closed together, the abutment button 54 of the suppressing unit 50 presses to the abutment body 44 of the shock detection module 40 and the abutment body 44 drives the shock sensor 43 inward displaced for the trigger zone 443 to contact with the electrical trigger 48 on the recessed flexible body 47 in order to trigger the control circuit 49 controlling the electric magnet 22 adsorbing the adsorption plate 32 to be in a lock state. After the door plate 14 is still, the present invention goes into a low power adsorption state. In the embodiment, the electrical trigger 48 may be any conductive material which can trigger the trigger zone 433. With the referenced to FIG. 11, the shaft 414 is upward push to the recessed flexible body 47 by a small spring 416.

The present invention provides the shock detection module 43 composed of the shock sensor 43 as a sensing member to sense the external environment change. In the preferred embodiment, the shock sensor 43 may be composed of an acceleration sensor which is called G-sensor hereafter. The G-sensor senses objects in a motion state generating the acceleration of gravity in a three-axis space and so-called a linear accelerometer. The G-sensor can sense the minute changes in the physical quantity, such as displacement and vibration. The shock sensor 43 is arranged on the spring 42; therefore, once the door plate 14 has a little displacement, the shock detection module 40 immediately senses the shock and trigger the control circuit 49 in a very short time to supply the normal power to the electric magnet 22 and to be in a lock state.

Therefore, the present invention provides the shock sensor 43 to link to the elastic member 42 such that when the door plate 14 is instantly displaced, the shock sensor 43 rapidly reacts through the elastic force of the elastic member 42; before the door plate 14 has been pushed and opened, the present invention returns to normal current supply, achieving the desired safety purpose. If the electromagnetic door lock 60 requires 1200 pounds of electromagnetic adsorption to stay in the lock state, the electromagnetic door lock 60 requires 500 mA current. Moreover, to maintain normal power supply for 24 hours, the power consumption is considerable. For this reason, the present invention provides small current such as 100 mA for the electric magnet 22 when the door plate 14 is still and closed such that the electromagnetic door lock 60 produces small adsorption to adsorb the adsorption plate 32. When people push or destroy the door, the shock sensor 43 reacts rapidly to return to the normal power supply and stay in a lock state with normal current, achieving access control security and saving power.

Figure 9A:
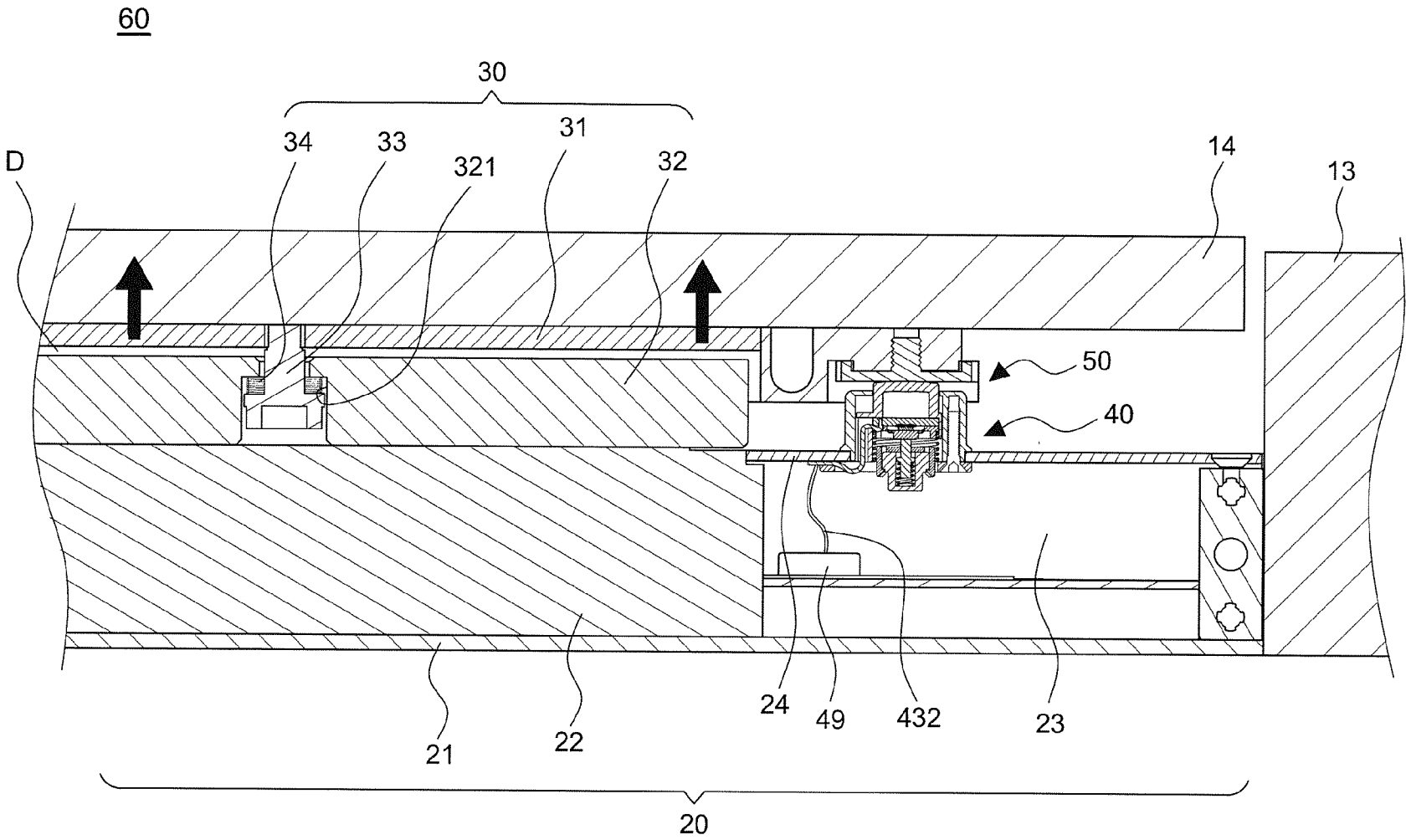
FIG. 9A is a schematic view of the present invention, illustrating the electromagnet assembly and adsorption assembly are to be separated.

Moreover, the present invention provides the adsorption assembly 30 to assist the shock detection module 40 wherein the mounted base 31 is locked on the door plate 14 and the adsorption plate 32 corresponding to the electric magnet 22 is boned contact. With the referenced to FIG. 9, the electric magnet 22 usually maintains basic adsorption with low power. With the referenced to FIG. 9A, when the door plate 14 is pushed, the adsorption plate 32 is still bonded with the electric magnet 22 and the mounted base 31 is displaced together with the door plate 14 for a small distance D. The spring 34 in the spot-faced hole 321 provides a displacement buffering function such that when the adsorption assembly 30 contacts with the door plate 14, there is enough time for the control circuit 49 sends the normal current to the electric magnet 22 in order to achieve the safety purpose.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electromagnetic doorlock with shock detection features and power saving features, comprising:

an electromagnet assembly having an electric magnet with an electromagnetic attraction feature and an adsorption assembly arranged on a corresponding surface thereof, a control circuit connected to the electric magnet;

detection module being electrically connected to the control circuit, wherein the control circuit supplies a current to the electric magnet for full power or a decreased current for reduced power responsive to an output of the detection module, the detection module includes:

a shock sensor arranged on an elastic member and electrically connected to the control circuit, a bottom surface of the shock sensor having a trigger zone thereon, and the elastic member being arranged on a plate;

a recessed flexible body arranged between the elastic member and the shock sensor;

an electrical trigger arranged on the recessed flexible body in correspondence with the trigger zone;

an abutment body arranged on the shock sensor and having a protrusion portion and a positioning flange at a periphery thereof, and a seat having an axial through hole for the abutment body to be axially telescoped therein and the telescopic abutment body driving the shock sensor together with the elastic member to provide an axial displacement thereof, the electrical trigger providing a conductive connection with the trigger zone responsive to the axial displacement of the shock sensor and elastic displacement of the recessed flexible body toward the shock sensor;

the adsorption assembly includes: an adsorption plate having a hole and locked on a door plate from an inner side thereof by the hole and a bolt, and a spring mounted on the bolt for having an elastic displacement space between the inner side of the adsorption plate and the door plate; a suppressing unit mounted on a periphery of the adsorption assembly and having a front side that contacts the protrusion portion of the abutment body;

whereby when the adsorption assembly is adsorbed by the electromagnet assembly, and the abutment body is axially displaced by the suppressing unit, the control circuit supplies full power to the electric magnet responsive to the conductive connection of the electrical trigger with the trigger zone and subsequently supplies a reduced power to the electric magnet absent an output of the shock sensor; when the abutment body of the detection module is displaced by an external action, the shock sensor is thereby triggered to provide an output to the control circuit to supply full power to the electric magnet and rapidly return to a normal lock state.

2. The electromagnetic doorlock with shock detection features and power saving features as claimed in claim 1, wherein the electromagnet assembly is arranged on a door frame and the adsorption assembly is correspondingly arranged on the door plate and the electromagnet assembly has a containing room with a cover at an opening thereof and the cover has a mounted hole thereon for mounting the detection module.

3. The electromagnetic doorlock with shock detection features and power saving features as claimed in claim 2, wherein the containing room is one of an independent molding structure that is mounted on the electromagnet assembly or is integrally molded with the electromagnet assembly.

4. The electromagnetic doorlock with shock detection and power saving device as claimed in claim 3, wherein the shock detection module further includes: the plate having a post hole with an upward opening at a center thereof and a hollow portion at an inner side thereof; a shaft having a flange at a middle section thereof and a small spring arranged at a lower section thereof and arranged in the post hole; a positioning sleeve having a hook body at a side thereof for fixing in a fixed hole arranged at a periphery of the post hole and corresponding to the post hole has a through hole for arranging an upper section of the shaft; the recessed flexible body having a recessed center corresponding to a top of the shaft.

5. The electromagnetic doorlock with shock detection features and power saving features as claimed in claim 4, wherein the abutment body of the detection module has a protrusion portion and a positioning flange at a periphery thereof and the seat has a positioning surface at a periphery of the axial through hole for the positioning flange to be abutted when the protrusion portion of the abutment body is upward pushed by the elastic body.

6. The electromagnetic doorlock with shock detection features and power saving features as claimed in claim 5, wherein the control circuit is arranged in the containing room of the electromagnet assembly and has an end thereof connected to an external power supply.

7. The electromagnetic doorlock with shock detection features and power saving features as claimed in claim 1, wherein the adsorption plate of the adsorption assembly is locked on one of the mounted base or the door plate.

8. The electromagnetic doorlock with shock detection features and power saving features as claimed in claim 1, wherein the shock sensor is an acceleration sensor.

9. The electromagnetic doorlock with shock detection features and power saving features as claimed in claim 1, wherein the elastic member of the detection module is a spring.

10. The electromagnetic doorlock with shock detection features and power saving features as claimed in claim 1, wherein the suppressing unit includes: a base having a recessed surface with a screw hole in a center thereof; and an abutment button having a front face corresponding to the abutment body of the detection module and a bottom face with a screw for screwing to the screw hole to adjust a height between the abutment button and a surface of the base.

11. An electromagnetic doorlock with shock detection features and power saving features, the device comprising:

an electromagnet assembly having an electric magnet with an electromagnetic attraction feature, and an adsorption assembly arranged on a corresponding surface thereof;

a detection module being electrically connected to the electromagnet assembly, the detection module including:

a shock sensor arranged on an elastic member and electrically connected to a control circuit, the elastic member arranged on a plate;

an abutment body arranged on the shock sensor and having a protrusion portion and a positioning flange at a periphery thereof, and a seat having an axial through hole for the abutment body to be axially telescoped therein and the telescopic abutment body driving the shock sensor together with the elastic member to provide an axially directed force to the abutment body;

the plate having a post hole with an upward opening at a center thereof and a hollow portion at an inner side thereof;

a shaft having a flange at a middle section thereof and a small spring arranged at a lower section thereof and arranged in the post hole;

a positioning sleeve having a hook body at a side thereof for fixing in a fixed hole arranged at a periphery of the post hole and corresponding to the post hole has a through hole for arranging an upper section of the shaft;

a recessed flexible body arranged between the elastic member and the shock sensor and having a recessed center corresponding to a top of the shaft; and an electrical trigger arranged on the recessed flexible body and corresponding to a trigger area at a bottom surface of the shock sensor;

the adsorption assembly includes:

an adsorption plate having a hole and locked on a door plate from an inner side thereof by the hole and a bolt, and a spring mounted on the bolt for having an elastic displacement space between the inner side of the adsorption plate and the door plate;

a suppressing unit mounted on a periphery of the adsorption assembly and having a front side contacted with the abutment body; whereby when the adsorption assembly is adsorbed by the electromagnet assembly, the abutment body is suppressed by the suppressing unit to simultaneously drive the inward movement of the shock sensor and compress the elastic member; at the same time, the electric magnet is in a low power adsorption state;

when the abutment body of the shock detection module is displaced by an external action, the shock sensor is triggered to return the electric magnet to a normal current supply and rapidly get into a normal lock state.

* * * * *